US005122396A

United States Patent [19]

Rantanen

[11] Patent Number: 5,122,396

[45] Date of Patent: Jun. 16, 1992

[54] METHOD AND DEVICE FOR LIMITATION OF THE WIDTH OF COATING OF PAPER

[75] Inventor: Rauno Rantanen, Muurame, Finland

[73] Assignee: Valmet Paper Machinery Inc., Finland

[21] Appl. No.: 686,027

[22] Filed: Apr. 16, 1991

[30] Foreign Application Priority Data

Apr. 19, 1990 [FI] Finland ..... 901965

[51] Int. Cl.[5] ..... B05C 1/08; B05D 1/28; B05D 1/40

[52] U.S. Cl. ..... 427/359; 15/256.52; 29/121.4; 118/117; 118/119; 118/414; 118/419; 118/262; 427/362; 427/428

[58] Field of Search ..... 118/262, 117, 119, 410, 118/414, 419; 29/121.4, 121.5; 427/288, 359, 361, 362, 428; 15/256.52

[56] References Cited

U.S. PATENT DOCUMENTS

| | | | |
|---|---|---|---|
| 3,238,058 | 3/1966 | Jeannin | 118/419 |
| 3,497,920 | 3/1970 | Brownell | 118/117 |
| 4,325,321 | 4/1982 | Wahnschaff | 118/245 |

FOREIGN PATENT DOCUMENTS

| | | | |
|---|---|---|---|
| 768818 | 8/1934 | France | 118/410 |

*Primary Examiner*—Michael G. Wityshyn
*Attorney, Agent, or Firm*—Steinberg & Raskin

[57] ABSTRACT

The invention concerns a device and method for limiting of the width of coating in coating of paper or board. The coating agent is spread onto a moving base to be coated by means of a coating device provided with a grooved coating bar. The coating agent is spread substantially only over the width of the web and any coating agent extending substantially beyond the web width is scraped off the base to be coated with the aid of smooth end areas fitted at both ends of the coating bar. The invention is also related to a device for carrying out the method.

7 Claims, 3 Drawing Sheets

METHOD AND DEVICE FOR LIMITATION OF THE WIDTH OF COATING OF PAPER

FIELD OF THE INVENTION

The invention concerns a device and method for limiting of the width of coating in coating of paper or board, wherein the coating agent is spread onto the moving base by means of a coating device provided with a grooved coating bar.

The device comprises a revolving coating bar, which rests against the moving base to be coated and extends across the machine width. A substantial portion of the revolving coating bar is provided with grooves. The coating bar is fitted to spread and to smooth the coating agent onto the base to be coated. The coating agent is introduced into the coating device in the direction of running of the base to be coated, before the coating bar.

BACKGROUND OF THE INVENTION

At present, in the coating of paper and board, two alternative methods and devices are commonly used, i.e. a blade coater or a bar coater. The present invention is expressly related to bar coaters, which have proved excellent especially in the surface-sizing technique. A bar coater is employed in coating and surface-sizing for spreading and smoothing the coating agent onto the surface of a paper or board web, to which the coating agent is introduced by means of a spreading roll.

In film size presses, the coating agent may also be introduced directly onto the faces of the rolls in the size press, from which, in the roll nip, it adheres to the web that passes through the nip. Coating bars currently in use ar usually made of steel. Coating bars are frequently provided with chromium plating to increase their service life. Bars with fully smooth faces are not used. Rather the bar face is provided with grooves, or steel wire may be wound onto the bar to form a solution similar to grooves on the bar face.

When the coating agent is applied by means of such a grooved coating bar, e.g., onto the rolls in the size press, the areas of the roll ends placed outside the web must be scraped clear by mean of lateral doctors. Otherwise the coating agent that remains in the end areas of the rolls causes considerable splashing in the roll nip.

The scraping of these lateral areas of the rolls has proved very difficult.

OBJECTS AND SUMMARY OF THE INVENTION

An object of the present invention is to provide a method and a device which overcomes the drawbacks of prior art coating bars and through which an improved coating result is achieved as compared with prior art.

In view of this objective and others, the present invention is directed in part to a method where the coating agent is spread substantially over the width of the web only, and any coating agent extending substantially beyond the web width is scraped off the base to be coated with the aid of smooth end areas fitted at both ends of the coating bar.

The device in accordance with the present invention relates to a coating bar wherein the grooves have been formed substantially across the web width, and the end areas of the coating bar that extend substantially beyond the web width have been formed smooth.

An important advantage of the invention over the prior art is that pursuant to the invention, it is possible to omit the lateral doctors completely, because they are unnecessary. In the method and device in accordance with the invention, the scraping of the lateral areas is carried out by means of the coating bar itself, the scraping already taking place at the stage of application of the coating. In the case of a size press, the area beyond the web width on the smooth bar portion is so small that the size passes through the nip without splashing. Further advantages and characteristics of the invention are set forth in the following detailed description of the invention.

BRIEF DESCRIPTION OF THE DRAWINGS

In the following, the invention will be described in detail with reference to the Figures in the accompanying drawings. The Figures of the accompanying drawings represent preferred embodiments of the invention, but should not be construed to limit the scope of the invention.

DETAILED DESCRIPTION

Figure 1:
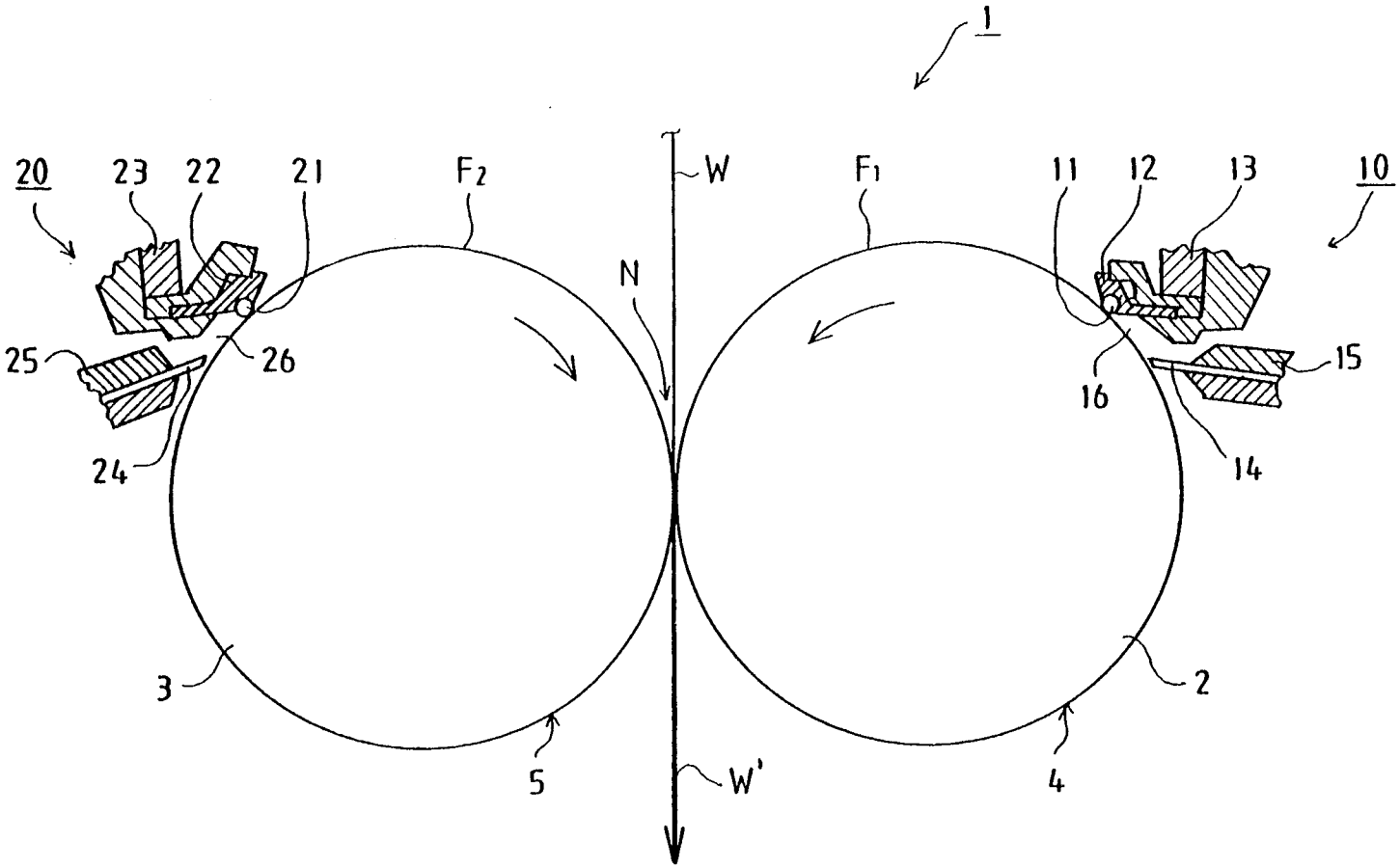
FIG. 1 is a schematic side view of a film size press in which the method and the device in accordance with the invention are applied.

In FIG. 1, the size press is denoted generally with the reference numeral 1. The film size press 1 comprises size press rolls 2 and 3. The first roll 2 and the second roll 3 form a nip N between them, the paper or board web W being passed through the nip. In the film size press 1, a first size film F1 is metered onto the face 4 of the first roll 2 by means of a first coating device 10 and, in a corresponding way, a second size film F2 is metered onto the face 5 of the second roll 3 by means of a second coating device 20. In the roll nip N, the size films F1 and F2 are transferred onto the paper or board web W running through the nip. In FIG. 1, the coated web is denoted with the reference W'.

In the film size press 1 shown in FIG. 1, the coating devices 10 and 20, by whose means the size films F1 and F2 are spread onto the faces 4 and 5 of the rolls 2 and 3 in the size press, are bar coaters, which are equal in size to one another, as is shown in FIG. 1. The coating devices 10 and 20 are of the so-called short-dwell type, in which the coating agent is introduced into a pressurized coating-agent chamber 16, 26 placed before the coating bar 11, 21. Besides being defined by the coating bar 11, 21, the chamber is also defined by the roll face 4, 5, the front wall 14, 24 of the coating-agent chamber, as well as by possible lateral seals, if any (not shown). The coating bar 11, 21 is fitted in a cradle 12, 22, which is made of a suitable material, e.g. polyurethane. The cradle supports the coating bar 11, 21 over its entire length. The coating bar 11, 21 is provided with a drive gear (not shown) which rotates the coating bar 11, 21 in directions opposite to the directions of rotation of the rolls 2, 3. The holders of the cradles of the coating bars in FIG. 1 are denoted with the reference numerals 13 and 23, and the holders of the front wall with the reference numerals 15 and 25.

Figure 2:
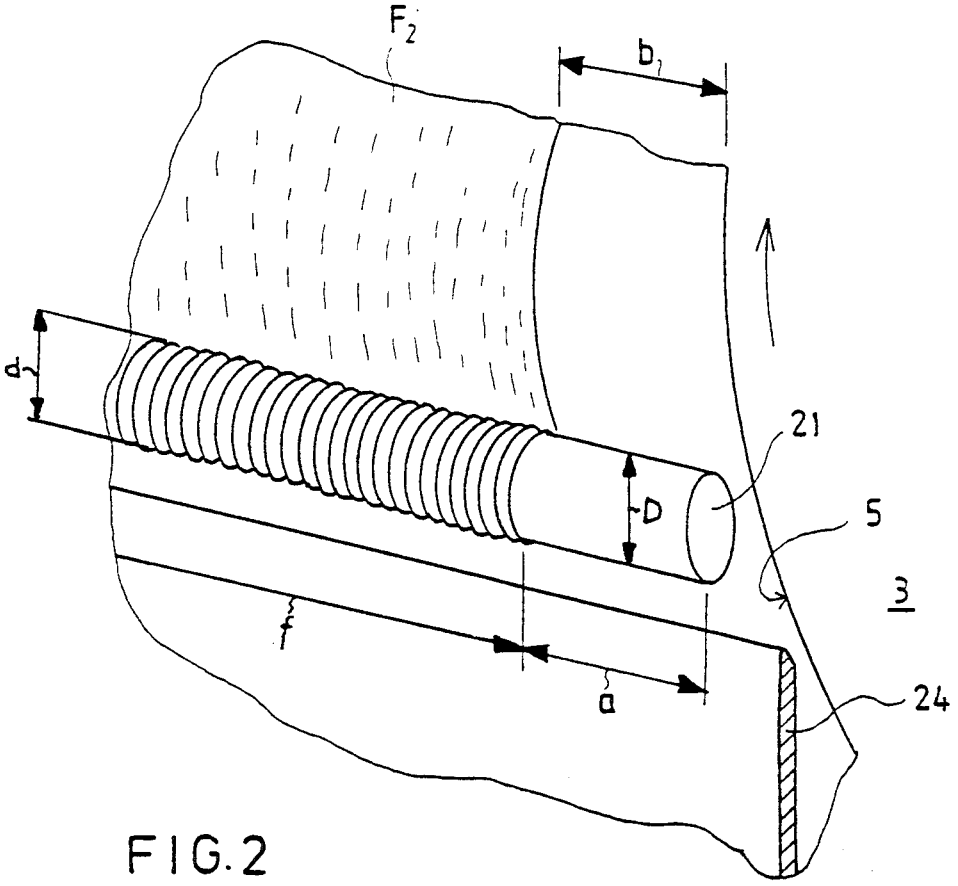
FIG. 2 is a plan view of a simplified illustration of one coating device in the film size press, shown on a larger scale.

In the invention, the coating bar used is a grooved bar 21, which is shown in more detail in FIG. 2. As shown in FIG. 2, the grooved bar 21 is not provided with grooves extending from end to end, but the end areas a at both ends of the bar remain smooth. The ratio of the grooved portion f and the smooth end areas a on the coating bar 21 has been chosen so that the grooves f have been formed onto the bar 21 to be of a width substantially equal to the width of the web. The outer diameter D of the bar 21 at the smooth end areas a is substantially equal to the outer diameter d of the grooved portion on the bar 21. Owing to this arrangement, on said smooth end areas a of the outer bar, any size extending beyond the width of the web is spread onto face 5 of the roll 3 in the end areas b of the roll so that the size layer is so thin that it passes through the roll nip N. In such a case, substantially no splashing occurs in the roll nip N.

Figure 3:
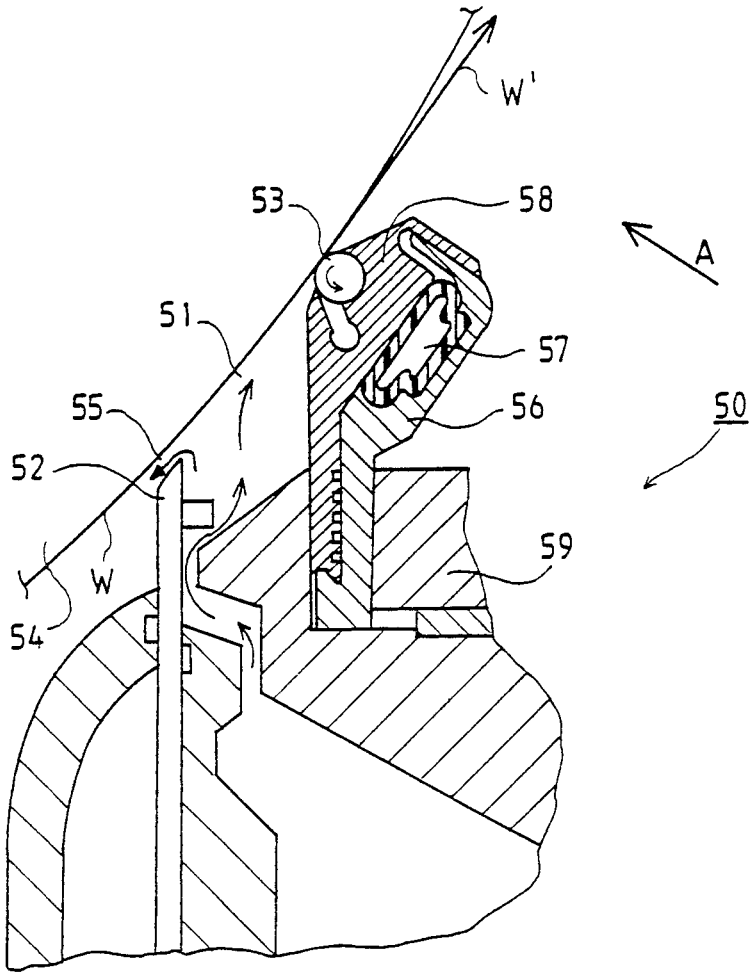
FIG. 3 is a schematic sectional side view of a bar coater which is employed for coating taking place directly onto the web surface.
Figure 4:
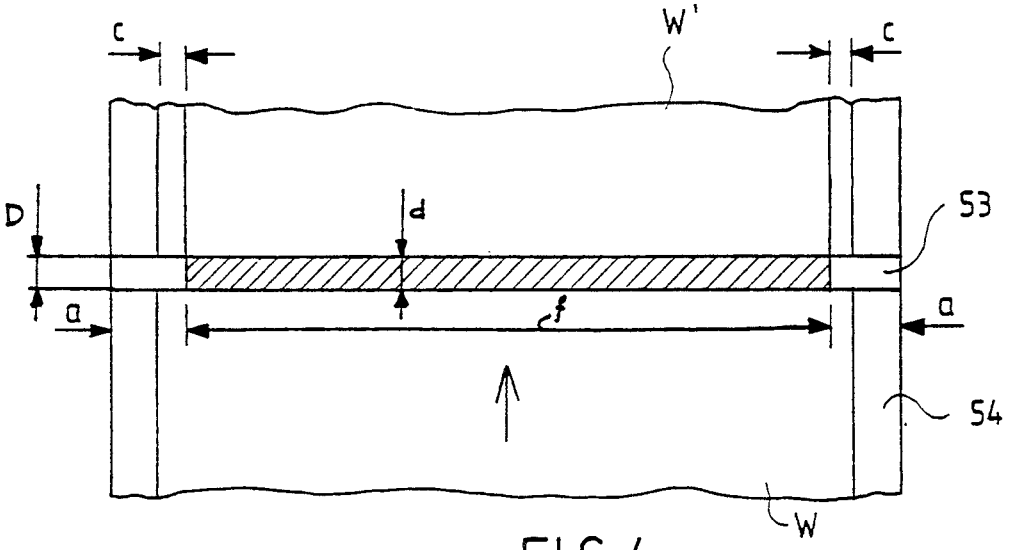
FIG. 4 is a simplified illustration of FIG. 3, viewed in the direction of the arrow A.

In FIGS. 3 and 4, a second embodiment of the invention is shown, which is applied to spreading of the coating agent directly onto the surface of the paper or board web W. In FIG. 3, the coating device is denoted generally with the reference numeral 50. As is shown in FIG. 3, the coating bar 53 is fitted against the paper or board web W that runs on the face of a backup roll 54. The coating device 50 is a coating device of so-called short-dwell type, in which the coating agent is introduced into a coating-agent chamber 51, which is placed in the direction of running of the web W and before the coating bar 53. In addition to the coating bar 53, the chamber is also defined by the web W, by the front wall 52 of the coating-agent chamber, and by lateral seals (not shown). The coating-agent chamber 51 is pressurized in the conventional way, and out of the chamber 51, overflow of the coating agent is provided through the gap 55 between the front wall of the coating-agent chamber and the web W. The coating bar 53 is fitted in a cradle 58 of a suitable material, e.g., polyurethane, said cradle supporting the coating bar 53 over its entire length. The coating bar 53 is provided with a drive gear (not known), by whose means the coating bar 53 is rotated in the direction opposite to the direction of running of the web W. The cradle 58 of the coating bar 53 is fitted on a support 56 and both the cradle 58 and the support 56 are together attached to the holder 59 fitted on the frame of the coating device 50. Moreover, on the support 56, underneath the cradle 58, a loading hose 57 is provided, by whose means the coating bar 53 can be loaded in the desired way against the web W. In FIGS. 3 and 4, the coated web is denoted with the reference W'.

As is shown in FIG. 4 the coating bar 53 is a grooved bar similar to that shown in FIGS. 1 and 2. Thus, the bar 53 is provided with grooves across its entire length, but the end areas a of the bar have been allowed to remain smooth so that the grooved portion f of the bar 53 extends substantially across the web width only, or, as is shown in FIG. 4, is slightly narrower than the web width so that dry lateral areas c remain in the web W' which is coated otherwise. Also, in the embodiment shown in FIGS. 3 and 4, the diameter D of the smooth end areas a of the bar 53 is substantially equal to the outer diameter d of the grooved portion of the bar.

The invention has been described by way of example with reference to the Figures in the accompanying drawing. The invention is, however, not confined to the exemplifying embodiments shown in the Figures alone, but many variations are possible within the scope of the inventive idea defined in the following patent claims.

What is claimed is:

1. A method for limiting the width of coating in the coating of a paper or board web where the coating is spread onto a moving base by means of a coating device provided with a grooved coating bar, comprising providing a coating bar having a grooved central area corresponding to the width of a web to be coated and smooth areas at both ends of said grooved central area, contacting a coating agent onto the surface of a moving base, spreading the coating agent substantially only over the width of the moving base, and scraping off a sufficient amount of the coating agent from the area of the moving base extending substantially beyond the width of the web via said smooth ends of said coating bar such that the moving base passes through a press nip substantially without splashing.

2. The method of claim 1, further comprising adapting the diameter of the smooth ends of the coating bar such that the lateral areas of the moving base remain substantially free from the coating agent.

3. A device for limiting the width of coating in the coating of a paper or board web, comprising a moving base carrying a web to be coated, the web having a width less than that of said moving base, a revolving coating bar resting against said web and said moving base and fitted to spread and to smooth a coating agent onto said web and said moving base, said coating bar substantially extending across the entire width of said moving base, said coating bar having a central portion provided with a grooved surface, said grooved surface being substantially equal in width to the web, and lateral portions provided with smooth surfaces, said lateral portions extending beyond the width of the web, said smooth surfaces adapted to spread the coating agent to a sufficient thinness on said moving base such that said moving base passes through a press nip substantially without splashing.

4. The device of claim 3, wherein said coating bar has a diameter, and the diameter of said lateral portions of said coating bar is substantially equal to the diameter of said central portion of said coating bar.

5. In a device for coating a paper or board web comprising a moving base and a revolving grooved coating bar substantially extending across the entire width of the moving base for spreading and smoothing a coating agent onto a web carried on the moving base, wherein a coating agent is introduced onto said web and said moving base before the coating bar in the direction of the running of the moving base, the moving base carries a web having a width which is less than that of the moving base, and the coating bar is provided with a grooved surface, the improvement comprising providing grooves on the coating bar substantially only across the width of the web, and providing smooth surfaces on lateral portions of the coating bar which extend beyond the width of the web, the smooth surfaces being adapted to spread the coating agent to sufficient thinness on the moving base such that the moving base passes through a press nip substantially without splashing.

6. The device of claim 5, wherein said coating bar has a diameter, and the diameter of said lateral portions of said coating bar is substantially equal to the diameter of said central portion of said coating bar.

7. A revolvable coating bar for use in a device for coating a paper or board web, said bar comprising a central portion having a grooved surface adapted to smooth and spread a coating agent onto a moving base carrying a web with said central portion being of a width substantially equal to the width of the web, and lateral ends provided with smooth surfaces, said lateral ends corresponding in width to lateral ends of the moving base extending beyond the width of the web, said coating bar having a diameter, said lateral ends having an outer diameter substantially equal to the outer diameter of said central portion.

* * * * *